US007398783B2

(12) United States Patent
Biggs et al.

(10) Patent No.: US 7,398,783 B2
(45) **Date of Patent: *Jul. 15, 2008**

(54) SMOKING ARTICLE

(75) Inventors: Philip John Biggs, Hythe (GB); Richard Thomas Gilbert, Lordswood (GB); Kevin Gerard McAdam, Whiteley (GB); Bhasker Natarajan, Mayfield Heights, OH (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 473 days.

This patent is subject to a terminal disclaimer.

(21) Appl. No.: 10/923,917

(22) Filed: Aug. 23, 2004

(65) Prior Publication Data

US 2005/0081869 A1 Apr. 21, 2005

Related U.S. Application Data

(62) Division of application No. 09/446,232, filed as application No. PCT/GB98/01586 on May 29, 1998, now Pat. No. 6,779,531.

(30) Foreign Application Priority Data

Jun. 19, 1997 (GB) ..... 9712815.1

(51) Int. Cl.
*A24B 15/00* (2006.01)
*A24F 7/00* (2006.01)

(52) U.S. Cl. ..... 131/352; 131/361; 131/334; 131/365; 131/241

(58) Field of Classification Search ..... 131/241
See application file for complete search history.

(56) References Cited

U.S. PATENT DOCUMENTS

| | | | | | |
|---|---|---|---|---|---|
| 1,829,559 | A | | 10/1931 | Gilliam | |
| 3,096,772 | A | | 7/1963 | Korber | |
| 3,349,776 | A | | 10/1967 | Bell et al. | |
| 3,614,956 | A | | 10/1971 | Thornton | |
| 3,736,941 | A | | 6/1973 | Mollins et al. | |
| 3,878,850 | A | * | 4/1975 | Gibson et al. | 131/275 |
| 3,910,287 | A | | 10/1975 | Walton | |
| 3,957,062 | A | | 5/1976 | Labbe et al. | |
| 3,987,804 | A | | 10/1976 | Mollins et al. | |
| 4,008,723 | A | * | 2/1977 | Borthwick et al. | 131/359 |
| 4,207,906 | A | | 6/1980 | Seehofer et al. | |
| 4,219,031 | A | | 8/1980 | Rainer et al. | |
| 4,624,268 | A | * | 11/1986 | Baker et al. | 131/332 |
| 4,632,130 | A | | 12/1986 | Heitmann et al. | |
| 4,727,888 | A | | 3/1988 | Luke | |
| 4,736,754 | A | | 4/1988 | Heitmann et al. | |
| 4,830,028 | A | | 5/1989 | Lawson et al. | |
| 4,874,004 | A | | 10/1989 | Borowski et al. | |
| 4,903,714 | A | * | 2/1990 | Barnes et al. | 131/335 |
| 4,917,121 | A | | 4/1990 | Riehl et al. | |
| 4,920,990 | A | | 5/1990 | Lawrence et al. | |
| 4,924,886 | A | | 5/1990 | Litzinger | |
| 4,986,287 | A | | 1/1991 | Schneider et al. | |
| 5,050,621 | A | * | 9/1991 | Creighton et al. | 131/331 |
| 5,056,537 | A | | 10/1991 | Brown et al. | |
| 5,074,321 | A | | 12/1991 | Gentry et al. | |
| 5,092,353 | A | | 3/1992 | Montoya et al. | |
| 5,105,838 | A | | 4/1992 | White et al. | |
| 5,190,061 | A | * | 3/1993 | Brackmann et al. | 131/332 |
| 5,379,789 | A | * | 1/1995 | Schneider et al. | 131/360 |
| 5,722,432 | A | * | 3/1998 | Luke et al. | 131/349 |
| 6,202,648 | B1 | | 3/2001 | Schumacher et al. | |
| 6,367,481 | B1 | | 4/2002 | Nichols et al. | |
| 6,378,528 | B1 | | 4/2002 | Beeson et al. | |

FOREIGN PATENT DOCUMENTS

| | | |
|---|---|---|
| GB | 1054557 | 1/1967 |
| GB | 1086443 | 10/1967 |
| GB | 1416020 | 12/1975 |
| GB | 2070409 | 9/1981 |
| WO | 9816125 | 4/1998 |
| WO | 9857556 | 12/1998 |

* cited by examiner

*Primary Examiner*—Philip C Tucker
*Assistant Examiner*—Phu H Nguyen
(74) *Attorney, Agent, or Firm*—Charles I. Sherman; Middleton Reutlinger

(57) ABSTRACT

The invention relates to a reconstituted smoking material which comprises a non-polyol aerosol generator, tobacco (optional), binder (optional) and inorganic filler. A further polyol aerosol generator may also be contained in the smoking material. There is also provided a smoking article containing such material in a conventional arrangement or with a core axially disposed within an annulus.

A further aspect of the invention is the provision of a polyol or non-polyol aerosol generator disposed in the filter element of a smoking article, which may contain the inventive smoking material. The aerosol material on the filter is eluted into the aerosol of the smoke on burning of the smoking article.

8 Claims, No Drawings

SMOKING ARTICLE

CROSS REFERENCE TO RELATED APPLICATIONS

This application is a divisional of and claims priority to and benefit from, U.S. patent application Ser. No. 09/446,232, filed on Feb. 14, 2000, now U.S. Pat. No. 6,779,531, issued on Ser. No. 08/24/2004, which is a '371 filing from PCT/GB98/01586, filed on May 29, 1998, which claims priority to Great Britain Patent Application (GB)9712815.1, filed on Jun. 19, 1997.

BACKGROUND OF THE INVENTION

The subject invention relates to smoking articles, cigarettes for example, and smoking material therefor.

The patents literature contains many proposals for smoking materials for use in place of conventional cut tobacco cigarette filler.

It is an object of the subject invention to provide new smoking materials which provide for mainstream smoke which although containing low levels of tobacco derived components, is fully acceptable to the consumer.

The subject invention provides a smoking material comprising a non-polyol aerosol generator, up to 20% by weight tobacco, binder at not more than 20% by weight and not less than 30% by weight inorganic filler.

Triethylene glycol diacetate ('TEGDA'), glycerol triacetate ('triacetin') or glycerol diacetate ('diacetin'), for example, can be used as the non-polyol aerosol generator either individually or in combination. As is well known to those skilled in smoking article science and technology, TEGDA and triacetin are substances with an established use as plasticisers (bonding agents) for cellulose acetate cigarette-filter tow. It was thus surprising to find that these substances and similar substances, when used as aerosol generating substances in smoking materials according to the subject invention, provide aerosols in mainstream smoke which smokers register as very acceptable.

Non-polyol aerosol generator is usefully present in smoking materials of the subject invention at levels in a range of about 2% to about 30% by weight. More usually the range will be about 5% to about 20% by weight, and more usually 5-15%.

Total aerosol generator can include a polyol aerosol generator, such as for example one or more of glycerol, propylene glycol and triethylene glycol.

Smoking materials according to the subject invention can, as will be readily appreciated by those skilled in the art, be fabricated by slurrying the components, in fine particulate form, with water and casting the slurry to sheet form on a band or wire sheet-forming machine or on a heated drum. An alternative is to feed a mixture of the components, together with water, to an extruder. The product of casting or extrusion is suitably cut and shredded to provide smoking material of particulate form.

If the components used to provide the smoking material do not include tobacco, then advantageously the smoking material, in particulate form, is blended with particulate tobacco. In such case, the smoking material expediently accounts for at least about 30% by weight of the blend. Suitably, the smoking material will account for the majority, by weight, of the blend, that is more than 50% by weight of the blend. The tobacco in the blend may be expanded tobacco.

A class of substance suitable for the selection therefrom of binder in smoking materials according to the subject invention is the alginates. Sodium alginate has been found to be advantageous. Other suitable binder substances are celluloses or modified celluloses, hydroxypropyl cellulose or carboxymethyl cellulose, for example, starches or modified starches and natural gums.

Suitable substances for use as inorganic filler are calcium carbonate, perlite, vermiculite, diatomaceous earth, colloidal silica, magnesium oxide, magnesium sulphate, magnesium carbonate or other low density inorganic filler materials known to those skilled in the art.

In smoking materials according to the subject invention inorganic filler is preferably present at a level of at least about 35%, preferably at least about 40% and more preferably at least about 45% by weight.

In smoking materials according to the subject invention tobacco may be present at less than 15%, preferably less than 10% and more preferably less than 5%. The binder of smoking materials according to the invention may be present at less than 15%, and more preferably less than 10% by weight.

Smoking materials according to the subject invention may comprise one or more mechanical stabiliser or strengthening materials, examples being cocoa, sugar and fibre, paper fibre for instance. Expansion medium, such as starch, pullulan or other polysaccharides or foaming agents, for example, and high fat or high oil materials, such as cocoa butter or olive oil, corn oil, for example, may also be advantageously included.

Smoking material according to the invention may be used in a conventional smoking article, either blended with another smoking material, which may be tobacco material, or not or in a coaxial arrangement, for example.

According to a second aspect of the subject invention a smoking article comprising a smokable rod and a filter, said rod comprising a core and an outer part, said core comprising a first particulate smoking material and a first cigarette paper wrapper enwrapping said first smoking material and said outer part comprising a second particulate smoking material disposed annularly about said core and a second cigarette paper wrapper enwrapping said second smoking material, wherein either of said first or said second smoking material comprises a non-polyol aerosol generator, up to 20% by weight tobacco, binder at not more than 20% by weight and not less than 30% by weight inorganic filler.

As will be observed, one of the said smoking materials of the smoking article of the second aspect of the subject invention is as per the smoking material of the first above recited aspect of the subject invention. The smoking material of the first above recited aspect of the subject invention may be present in both the first smoking material and the second smoking material of the smoking article above.

Preferably the said second smoking material of the smoking article is as per the smoking material of the first above recited aspect of the subject invention.

Expediently, the first smoking material is cut tobacco filler, suitably cut lamina filler.

Much by preference, in smoking articles in accordance with the subject invention both the core and the outer part of the smokable rod extend over the full length of the rod. It is much by preference too for the core to be disposed coaxially of the rod.

In a third aspect of the invention, there is provided a smoking article comprising a smokable rod and a filter, the smokable rod comprising smoking material and the filter comprising filtration material provided with an elutable aerosol generator which is a polyol and/or a non-polyol aerosol generator, the aerosol generator being elutable from the filter upon smoking of the smoking article to enhance the aerosol provided from the smoking material.

The smoking article may be of a coaxial arrangement or non-coaxial arrangement.

Advantageously the smoking material comprises an aerosol generator, a binder and an inorganic filler, and is more advantageously comprised of a non-polyol aerosol generator, up to 20% by weight tobacco, binder at not more than 20% by weight and not less than 30% by weight inorganic filler. Alternatively the smoking material may comprise one or more of the aerosol generating means or aerosol generating fuel sources of our co-pending application filed on 6 Sep. 1995 under International Patent Application No. PCT/GB 95/02110. As a further alternative, the smoking material may comprise conventional cut tobacco leaf material.

The aerosol generator may be a polyhydric alcohol, an ester, a high boiling point hydrocarbon, glycerol, propylene glycol, triethylene glycol, methylene glycol, methyl citrate, triacetin or diacetin, either alone or in combination.

In a smoking article of an exterior circumference conventional for a cigarette, i.e. c.25 mm, the exterior circumference of the said core is suitably about 17 mm.

EXAMPLE 1

A smoking article, a cigarette, exemplary of the subject invention comprised a core of approximately 17 mm circumference, which core consisted of cut lamina filler conventional for ultra-slim cigarettes, such, for example, as the ultra-slim cigarette made by British American Tobacco (Germany) under the brand name CAPRICE, and a wrapper of conventional cigarette paper. The outer part of the cigarette disposed annularly about the core consisted of a blend of 50% by weight of expanded lamina tobacco and 50% by weight of a smoking material according to the subject invention enwrapped in an outer wrapper of low sidestream cigarette paper made by Glatz Inc. under the experimental designation GNS40MV. The expanded tobacco had been expanded by the well known Dry Ice Expanded Tobacco (DIET) tobacco expansion process. The smoking material according to the subject invention, which had been band cast and then cut and shredded, had a percentage composition by weight as follows.

| | |
|---|---|
| TEGDA | 2.6 |
| Glycerol | 6.5 |
| Conventional Tobacco Blend (ground) | 19.8 |
| Sodium Alginate | 9.9 |
| Chalk | 48.3 |
| Cocoa | 6.4 |
| Demerera Sugar | 3.0 |
| Paper Fibre | 3.5 |

The core and the outer part were lengthwise coterminous.

The cigarette according to the subject invention further comprised a conventional ventilated fibrous cellulose acetate filter.

EXAMPLE 2

A second exemplary smoking material in accordance with the subject invention is of a percentage composition by weight as follows.

| | |
|---|---|
| TEGDA | 6 |
| Glycerol | 6 |
| Conventional Tobacco Blend (ground) | 20 |

-continued

| | |
|---|---|
| Sodium Alginate | 10 |
| Chalk | 51 |
| Cocoa | 4 |
| Demerera Sugar | 3 |

This second smoking material in cut and shredded form could, for example, be blended with a conventional cut tobacco cigarette filler. The ratio in the blend of smoking material to filler might, for instance, be 7:3. The blend could be fed to a cigarette making machine to provide cigarette rod comprising the blend and a wrapper of conventional cigarette paper or a low sidestream paper, for example.

EXAMPLE 3

A third exemplary smoking material in accordance with the subject invention is of a percentage composition by weight as follows.

| | |
|---|---|
| TEGDA | 10 |
| Glycerol | 4 |
| Sodium Alginate | 8 |
| Chalk | 78 |

This third smoking material in cut and shredded form could, for example, be blended with conventional cut tobacco filler in a ratio of, for instance, 4:6 and used for the provision of cigarette rod.

EXAMPLE 4

The following three smoking material formulations were prepared for comparison. The compositions are percentage by weight of each component.

TABLE 1

| | Sample Number | | |
|---|---|---|---|
| | 1 | 2 | 3 |
| Triacetin | 0 | 9.6 | 4 |
| Glycerol | 8.6 | 0 | 4 |
| Conventional Tobacco Blend (ground) | 20.3 | 20.1 | 20 |
| Sodium Alginate | 8.1 | 8 | 8 |
| Fibre | 1 | 1 | 1 |
| Perlite | 62 | 61.3 | 63 |
| Smoke Deliveries | | | |
| Puff No. | 3.4 | 5.3 | 4.0 |
| TPM (mg/cig) | 7.5 | 5.3 | 7.6 |
| Water (mg/cig) | 2.7 | 0.8 | 2.1 |
| Nicotine (mg/cig) | 0.19 | 0.1 | 0.2 |
| Glycerol (mg/cig) | 1.11 | n/m | n/m |
| Triacetin | n/m | 2.03 | n/m |
| NFDPM (mg/cig) | 4.59 | 4.36 | 5.35 |
| NAFDPM (mg/cig) | 3.48 | 2.33 | n/m |

NAFDM = Nicotine, aerosol free dry particulate matter (aerosol being glycerol or triacetin).
NFDPM = Nicotine free dry particulate matter.
n/m = Not measured The cigarettes were smoked under standard machine smoking conditions of 35 $cm^3$ puff of 2 seconds duration taken every minute to a butt length of 35 mm.

EXAMPLE 5

In order to observe the influence of an aerosol generator held on a filter element against a smoking article having a standard fibrous cellulose acetate filter the mixed glycerol and triacetin sheet (Sample 3 of Example 4 above) was used in smoking articles with an aerosol generator in the filter at various levels. The cigarettes were of 84 mm length, c.8 mm diameter with a 27 mm filter element and were smoked under standard machine smoking conditions to 35 mm butt length. The aerosol generator on the filter was propylene glycol (PG).

TABLE 2

| | Sample Number | | | | |
|---|---|---|---|---|---|
| | 4 | 5 | 6 | 7 | 8 |
| PG on filter (mg) | 0 | 5 | 10 | 20 | 30 |
| Smoke Deliveries | | | | | |
| Puff Number | 4 | 4 | 4 | 3.75 | 4 |
| TPM (mg/cig) | 7.6 | 5.7 | 7.56 | 8.4 | 11.6 |
| Water (mg/cig) | 2.05 | 1.35 | 1.33 | 1.58 | 2.23 |
| Nicotine (mg/cig) | 0.20 | 0.17 | 0.17 | 0.13 | 0.15 |
| NFDPM (mg/cig) | 5.35 | 4.18 | 6.06 | 6.69 | 9.22 |
| % Smoke Composition | | | | | |
| Water (%) | 27.0 | 23.7 | 17.6 | 18.8 | 19.2 |
| Nicotine(%) | 2.6 | 3.0 | 2.2 | 1.5 | 1.3 |

It can be seen that the presence of additional aerosol generator dilutes the smoke constituents and provides a useful means for reducing the smoke delivery levels of various smoke components.

EXAMPLE 6

Other formulations of smoking material according to the invention were made according to Table 3. Additional materials included starch, oils and alkaline water. In Sample 58*a* a 0.1M solution of sodium carbonate was made up and added to the dry mixture instead of the usual water, until the required pH was reached. The compositions are percentage by weight of each component.

The invention claimed is:

1. A smoking article comprising a smokable rod and a filter, said rod comprising a core and an outer part, said core comprising a first smoking material and a first cigarette paper wrapper enwrapping said first smoking material and said outer part comprising a second smoking material disposed annularly about said core and a second cigarette paper wrapper enwrapping said second smoking material, wherein either of said first or said second smoking material comprises from 6 to 30% by weight of a non-polyol aerosol generator, selected from the group consisting of triethylene glycol diacetate, glycerol triacetate, glycerol diacetate or a combination thereof, up to 20% by weight tobacco, binder at not more than 20% by weight and not less than 30% by weight inorganic filler of $CaCO_3$.

2. A smoking article according to claim 1, wherein said smoking material of either of said first or second smoking material is particulate.

3. A smoking article according to claim 1, wherein both said first and said second smoking materials comprise from 6 to 30% by weight of said non-polyol aerosol generator, up to 20% by weight tobacco, binder at not more than 20% by weight and not less than 30% by weight inorganic filler of $CaCO_3$.

4. A smoking article according to claim 1, wherein the other of said first or second smoking material is cut tobacco filler.

5. A smoking article according to claim 1, wherein both said core and said outer part of said smokable rod extend over the full length of said rod.

6. A smoking article according claim 1 wherein said core is disposed coaxially of said rod.

7. A smoking article according to claim 1 and the filter comprising filtration material containing an elutable aerosol generator which is a polyol and/or a non-polyol aerosol generator, said elutable aerosol generator being elutable from the filter upon smoking of the smoking article to enhance the aerosol provided from the smoking material.

TABLE 3

| Sample No. | Tobacco | Sodium Alginate | Sugar | Cocoa | Chalk | Glycerol | Tegda | Triacetin | Other Components |
|---|---|---|---|---|---|---|---|---|---|
| 2a | 20 | 10 | 15 | 4 | 39 | 6 | 6 | | |
| 3a | 20 | 10 | 3 | 20 | 35 | 6 | 6 | | |
| 5a | 20 | 10 | 3 | 4 | 37 | 6 | 20 | | |
| 7a | 20 | 10 | 3 | 4 | 51 | 6 | — | 6 | |
| 8a | 20 | 10 | 3 | 4 | 37 | 6 | — | 20 | |
| 10a | 20 | 10 | 3 | 4 | 51 | — | 12 | — | |
| 11a | 18 | 9 | 3 | 4 | 56 | — | 10 | — | |
| 12a | 20 | 10 | 3 | 4 | 41 | 6 | 6 | — | 10 (Paper Fibre) |
| 16a | 20 | 10 | 3 | — | 45 | 6 | 6 | — | 10 (Starch) |
| 17a | 20 | 10 | 3 | — | 45 | 6 | 6 | — | 10 (Cocoa Butter) |
| 26a | 20 | 25 | 3 | 4 | 36 | 6 | 6 | — | |
| 34a | 20 | 10 | 3 | — | 45 | 6 | 6 | — | 10 (Corn oil) |
| 39a | 20 | 10 | — | — | 55 | — | — | 15 | |
| 41a | 20 | 10 | 3 | 4 | — | 6 | 6 | — | 51 (Perlite) |
| 42a | 20 | 10 | 3 | 4 | 26 | 6 | 6 | — | 25 (Perlite) |
| 51a | 20 | 10 | 3 | — | 30 | 6 | 6 | — | 15 (Cooked Starch) |
| 52a | 20 | 10 | — | — | 55 | — | — | — | 15 (Olive Oil) |
| 58a | 20 | 10 | 3 | 4 | 51 | 6 | 6 | — | pH = 9.3 |

8. A smoking article comprising a smokable rod and a filter, said rod comprising a core and an outer part, said core comprising a first smoking material and said outer part comprising a second smoking material disposed annularly about said core, wherein either of said first or said second smoking material comprises from 6 to 30% by weight of a non-polyol aerosol generator, up to 20% by weight tobacco, binder at not more than 20% by weight and not less than 30% by weight chalk.

* * * * *